US007646878B2

(12) United States Patent
Vonlanthen et al.

(10) Patent No.: US 7,646,878 B2
(45) Date of Patent: Jan. 12, 2010

(54) HEARING DEVICE WITH BATTERY DOOR

(75) Inventors: Andi Vonlanthen, Remetschwil (CH); Richard Niccolai, Uster (CH); Urs Zuger, Gruningen (CH)

(73) Assignee: Phonak AG, Stafa (CH)

( * ) Notice: Subject to any disclaimer, the term of this patent is extended or adjusted under 35 U.S.C. 154(b) by 741 days.

(21) Appl. No.: 11/185,311

(22) Filed: Jul. 20, 2005

(65) Prior Publication Data

US 2007/0036372 A1 Feb. 15, 2007

(51) Int. Cl.
*H04R 25/00* (2006.01)

(52) U.S. Cl. ..... 381/322; 381/324

(58) Field of Classification Search ..... 381/312, 381/322, 323, 324, 361
See application file for complete search history.

(56) References Cited

U.S. PATENT DOCUMENTS 4,890,330 A 12/1989 Meyer
7,076,075 B2 * 7/2006 Jorgensen ..... 381/323

FOREIGN PATENT DOCUMENTS

DE 3723809 A1 * 1/1989

OTHER PUBLICATIONS

DE 3723809 A1, Montag, Juergen Dipling, Abstract Translation, Jan. 26, 1989, pp. 1 and 2.*
Montag, Juergen, Machine Translation of DE 3723809, Jan. 26, 1989.*

* cited by examiner

*Primary Examiner*—Brian Ensey
(74) *Attorney, Agent, or Firm*—Pearne & Gordon LLP

(57) ABSTRACT

The hearing device comprises a housing with electronic components and a battery compartment with an opening in the housing. The battery compartment comprises means for removeably engaging a battery door. The hearing device further comprises a set of battery doors, each comprising mechanical means for detachably receiving a battery, the shells of each battery door of the set of battery doors having different shapes and sizes, each adapted to the size of the assigned specific battery type.

4 Claims, 3 Drawing Sheets

HEARING DEVICE WITH BATTERY DOOR

BACKGROUND OF THE INVENTION

The present invention relates to a hearing device with a battery compartment.

Hearing devices such as in-the-ear hearing aids, behind-the-ear hearing aids, hearing instruments or miniaturized active earphones usually have a battery compartment for carrying one or more batteries for supplying the electronic or electric components of the device with electricity. As the battery will have to be removed or exchanged from time to time, this battery compartment is closed by a battery door to be opened on demand and to firmly close the battery compartment for regular use of the hearing device.

The electronic or electric components of the hearing device are usually designed to be supplied by a specific battery type and thus the battery compartment, especially the geometric dimensions of such a compartment, are defined by the geometric dimensions of the specific battery type.

In U.S. Pat. No. 4,890,330 a removeably attached battery compartment is shown. The standard battery compartment, comprising the battery, may be exchanged by an alternative battery compartment comprising the battery and additional audio connecting means. This alternative battery compartment is geometrically bigger than the standard battery compartment, thus providing space for incorporating additional audio connecting means beside the unique battery type.

The capacity of a battery increases with its geometrical volume. Thus the bigger the geometrical volume of the battery is, the longer its lifetime and thus the time period between the changing of the batteries will increase as well. Such long-life batteries require a greater amount of space in the battery compartment which results in an increase of the overall size of the hearing device. It depends on the individual demands if the need for a small housing or the need for a long battery lifetime prevails.

SUMMARY OF THE INVENTION

It is an object of the present invention to provide a hearing device being easily adaptable to individual needs of end users with respect to the battery lifetime.

The present invention provides a hearing device comprising a housing with electronic components and a battery compartment with an opening in the housing, the battery compartment comprising means for removeably engaging a battery door, a set of battery doors, each comprising mechanical means for detachably receiving a battery, the shells of each battery door of the set of battery doors having different shapes and sizes, each adapted to the size of the assigned specific battery type.

According to the individual needs of the user of the hearing device the battery door for the battery matching those individual needs may be chosen from the set of battery doors and engaged with the housing of the hearing device. By choosing a small battery type with a reduced lifetime, the respective battery door will have a reduced size as well, and the overall size of the hearing device will be reduced. By choosing a bigger battery type, the lifetime of the battery will be higher and thus the replacement cycle will be longer. By using the appropriate battery door out of the set of battery doors, the overall size of the hearing device will increase.

By providing the set of battery doors with different sizes, the user of the hearing device may decide according to the circumstances to change the battery door for either having a smaller overall size of the hearing device or to benefit of a longer lifetime of the battery as well as easier handling when replacing the battery.

In one embodiment, the hearing device further comprises electrical means for electrically contacting the battery and contact elements to establish a connection to the electronic components of the housing. It is thus possible to already have connected the electronic components with the battery even if the battery door is open.

Alternatively, the contact elements may be arranged within the battery compartment itself to connect the electronic components with the battery only in the closed position of the battery door.

In another embodiment, the hearing device comprises a pin, bar or screw located in the opening of the battery compartment of the housing for receiving one of said battery doors. The battery door may be connected to this pin, bar or screw and be pivoted around this pin, bar or screw for opening or closing the battery compartment.

In another embodiment, the battery doors comprise resilient snap-in tongues to detachably connect a battery door with the pin, bar or screw. A replacement of the battery doors may therefore easily be performed even by the user of the hearing device, without the need of any special tool.

DESCRIPTION OF THE DRAWINGS

For the purpose of facilitating and understanding of the invention, there is illustrated in the accompanying drawings a preferred embodiment thereof to be considered in connection with the following description. Thus the invention may be readily understood and appreciated.

DESCRIPTION OF A PREFERRED EMBODIMENT

Figure 1:
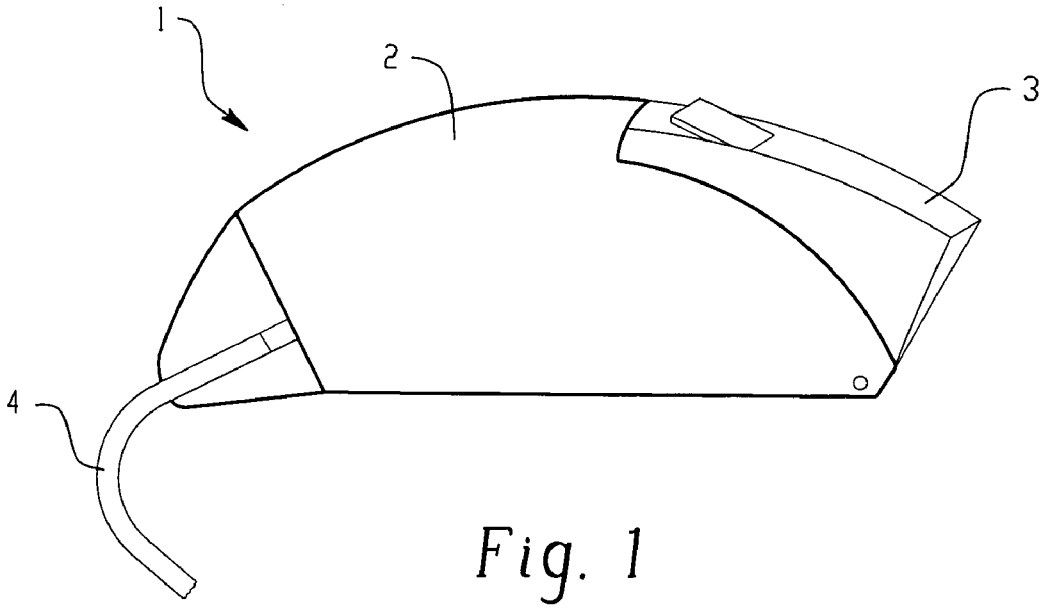
FIG. 1 is a side view of a hearing device according to the present invention with closed battery door.

Referring to FIG. 1, a hearing device 1 serving as a behind-the-ear hearing aid with a housing 2 and a battery door 3 in its closed position is shown. At one end of the housing 2, a hook or tube 4 is provided for transmitting the acoustical signal emitted from the loudspeaker (often also referred to as "receiver") of the hearing device 1 to the ear canal of the user of the hearing device 1.

The electronic components of the hearing device 1 are conventionally arranged inside of the housing 2.

Figure 2:
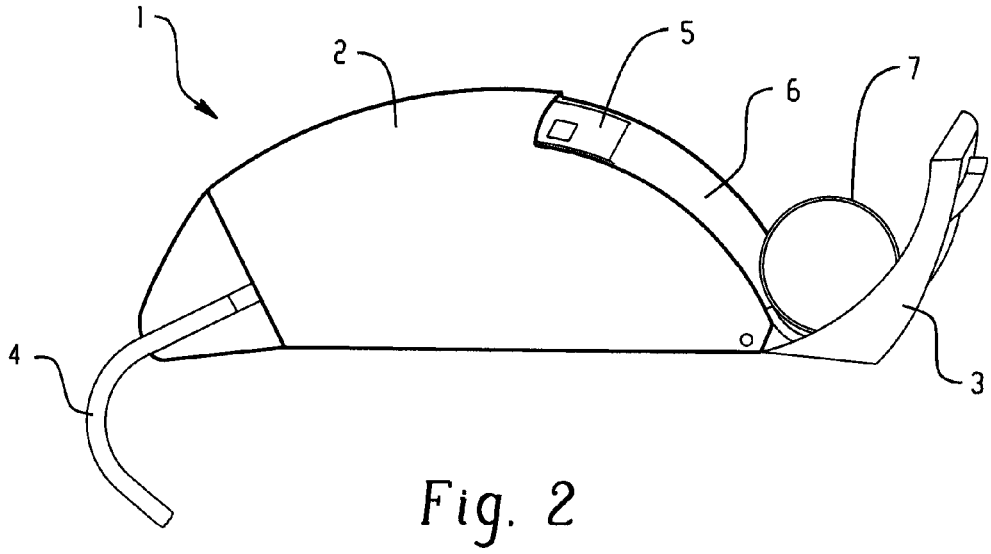
FIG. 2 is the side view of the hearing device of FIG. 1 with opened battery door.

In FIG. 2, the battery door 3 is shown in its opened position, showing the opening 5 of the battery compartment 6 of the housing 2. The battery door 3 comprises a support 7 for receiving a battery (not shown), i.e. a button-type battery commonly used in miniaturized electrical or electronic devices.

The size of the battery door 3 is adapted to just receive a battery of a certain geometrical dimension. As the diameter or dimension of the battery assigned to this battery door 3 is bigger than the space available within the battery compartment 6 of the housing 2, the shell of the battery door 3 is formed as a box to receive a part of the battery within this box volume. The overall size of the hearing device 1 thus exceeds the shape of the housing 2, thus increasing the overall size of the hearing device 1 by providing a high lifetime of the battery. The replacement interval for the battery therefore increases with respect of the use of a smaller battery.

Figure 3:
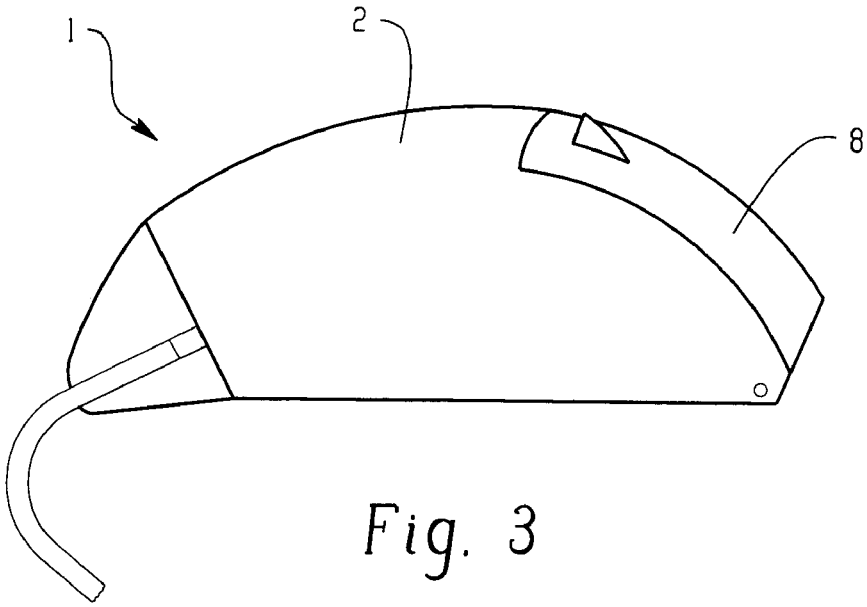
FIG. 3 is a side view of the same hearing device as shown in FIG. 1 equipped with a further battery door of the set of battery doors according to the present invention.

In FIG. 3, the hearing device 1 is again shown with a further battery door 8 from the set of battery doors assigned to the hearing device 1 or the housing 2 respectively. This battery door 8 fits the shape of the housing 2 of the hearing device in its closed position, thus does not influence the overall size of the hearing aid 1.

Figure 4:
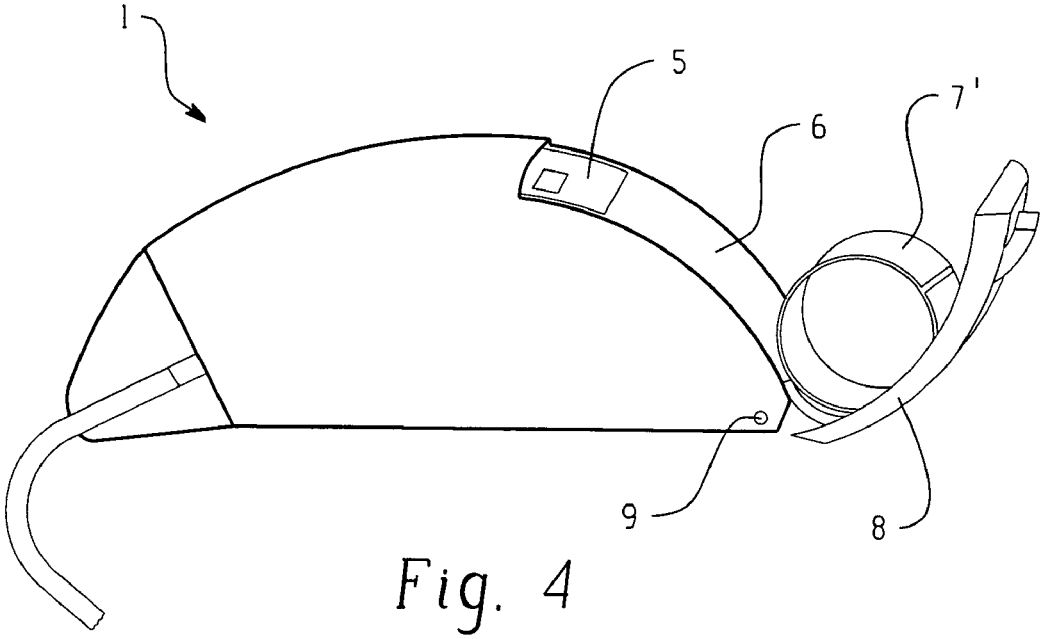
FIG. 4 is the side view of the hearing device of FIG. 3 with opened battery door.

In FIG. 4 the battery door 8 is shown in its opened position. The support 7' for another type of battery, e.g. a small button-type battery, is formed as an open tube to receive and hold in place the respective battery. As this type of small battery may be entered entirely into the battery compartment 6, the shell of the battery door 8 is just formed as a curved cap according to the outer shape of the housing 2 of the hearing device 1.

The battery doors 3 and 8 are pivotably attached to the housing 2 over an axis or pin 9 arranged at one end of the opening 5 of the battery compartment 6. The battery doors 3 or 8 may be detachably snapped on to this pin 9 for an easy exchange of the battery door 3 or 8.

We claim:

1. Hearing device comprising a housing with electronic components and a single battery compartment with an opening in the housing, the single battery compartment comprising means for removeably engaging a battery door, a set of battery doors, each battery door comprising a shell and mechanical means for detachably receiving a battery of an assigned specific battery type, the shell of each battery door of the set of battery doors having a different shape and size, each adapted to the shape and size of the assigned specific battery type.

2. Hearing device according to claim 1, comprising a pin, bar or screw located in the opening of the battery compartment of the housing for receiving one of said battery doors.

3. Hearing device comprising a housing having a single battery compartment, the housing having an opening providing access to the single battery compartment; a set of battery doors each removeably mountable on the housing to close the opening and configured to detachably receive a battery, each of the battery doors of the set having different shape and size adapted to receive an assigned specific battery type.

4. Hearing device according to claim 3 further comprising electronic components in the housing.

* * * * *

UNITED STATES PATENT AND TRADEMARK OFFICE

CERTIFICATE OF CORRECTION

PATENT NO. : 7,646,878 B2
APPLICATION NO. : 11/185311
DATED : January 12, 2010
INVENTOR(S) : Vonlanthen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1181 days.

Signed and Sealed this

Sixteenth Day of November, 2010

David J. Kappos

David J. Kappos
*Director of the United States Patent and Trademark Office*